US008056303B2

(12) United States Patent
Frobosilo

(10) Patent No.: US 8,056,303 B2
(45) Date of Patent: Nov. 15, 2011

(54) NON LOAD-BEARING METAL WALL STUD HAVING INCREASED STRENGTH

(76) Inventor: Raymond C. Frobosilo, Edison, NJ (US)

( * ) Notice: Subject to any disclaimer, the term of this patent is extended or adjusted under 35 U.S.C. 154(b) by 83 days.

(21) Appl. No.: 12/436,622

(22) Filed: May 6, 2009

(65) Prior Publication Data

US 2010/0281821 A1 Nov. 11, 2010

(51) Int. Cl.
*E04C 3/00* (2006.01)

(52) U.S. Cl. ..... 52/852; 52/831; 52/836; 52/846; 52/850

(58) Field of Classification Search ..... 52/831, 52/836, 846, 850, 852, 481.1
See application file for complete search history.

(56) References Cited

U.S. PATENT DOCUMENTS 2,180,317 A * 11/1939 Davis ..... 52/319
2,371,921 A * 3/1945 Tucker ..... 52/667
3,165,815 A * 1/1965 Wogerbauer ..... 29/897
3,194,408 A * 7/1965 Kimpton ..... 211/191
3,243,930 A * 4/1966 Slowinski ..... 52/364
4,011,704 A * 3/1977 O'Konski ..... 52/481.1
4,016,700 A * 4/1977 Blomstedt ..... 52/481.1
4,112,636 A * 9/1978 Hays ..... 52/98
5,561,955 A 10/1996 Frobosilo et al.
5,687,538 A * 11/1997 Frobosilo et al. ..... 52/846
5,720,571 A 2/1998 Frobosilo et al.
5,836,131 A 11/1998 Viola et al.
5,846,018 A 12/1998 Frobosilo et al.
5,927,041 A * 7/1999 Sedlmeier et al. ..... 52/836
6,092,349 A * 7/2000 Trenerry ..... 52/846
6,205,740 B1 * 3/2001 Ekerholm et al. ..... 52/846
6,213,679 B1 4/2001 Frobosilo et al.
6,381,916 B1 * 5/2002 Maisch et al. ..... 52/846
6,397,550 B1 * 6/2002 Walker et al. ..... 52/653.1
6,436,552 B1 8/2002 Walker et al.
6,854,397 B2 * 2/2005 Terajima et al. ..... 104/95
6,871,470 B1 * 3/2005 Stover ..... 52/648.1
6,964,140 B2 11/2005 Walker et al.
7,356,970 B1 4/2008 Frobosilo
7,383,665 B2 6/2008 Frobosilo
7,478,505 B2 1/2009 Frobosilo
7,836,657 B1 * 11/2010 diGirolamo et al. ..... 52/712
2004/0074200 A1 * 4/2004 Attalla ..... 52/731.1
2004/0139684 A1 * 7/2004 Menendez ..... 52/720.1
2006/0075715 A1 4/2006 Serpico et al.
2006/0144009 A1 * 7/2006 Attalla ..... 52/720.1
2007/0068113 A1 * 3/2007 St. Quinton ..... 52/731.1
2008/0110126 A1 * 5/2008 Howchin ..... 52/630
2008/0209832 A1 * 9/2008 Near ..... 52/481.1
(Continued)

FOREIGN PATENT DOCUMENTS

WO WO 2007137618 A1 * 12/2007

*Primary Examiner* — Brian Glessner
*Assistant Examiner* — Joshua Ihezie
(74) *Attorney, Agent, or Firm* — Notaro, Michalos & Zaccaria P.C.

(57) ABSTRACT

A non load-bearing metal wall stud has a sheet metal body with a web, a pair of flanges extending at right angles to the web, a pair of lips, each extending at a right angle from a straight edge of one of the flanges and a pair of skirts each extending at an angle from the straight edge of one of the lips. Knurled channels in the flanges and in the web stiffen the stud further.

8 Claims, 4 Drawing Sheets

U.S. PATENT DOCUMENTS

2009/0113827 A1* 5/2009 Stone et al. ..... 52/223.12
2009/0113846 A1* 5/2009 Knauf ..... 52/846
2009/0126315 A1* 5/2009 Knauf ..... 52/846
2009/0178369 A1* 7/2009 Pilz et al. ..... 52/781.3
2009/0249743 A1* 10/2009 Bodnar ..... 52/846
2010/0050569 A1* 3/2010 Dutra ..... 52/836
2010/0126106 A1* 5/2010 Ivarsson ..... 52/696

* cited by examiner

FIG. 2
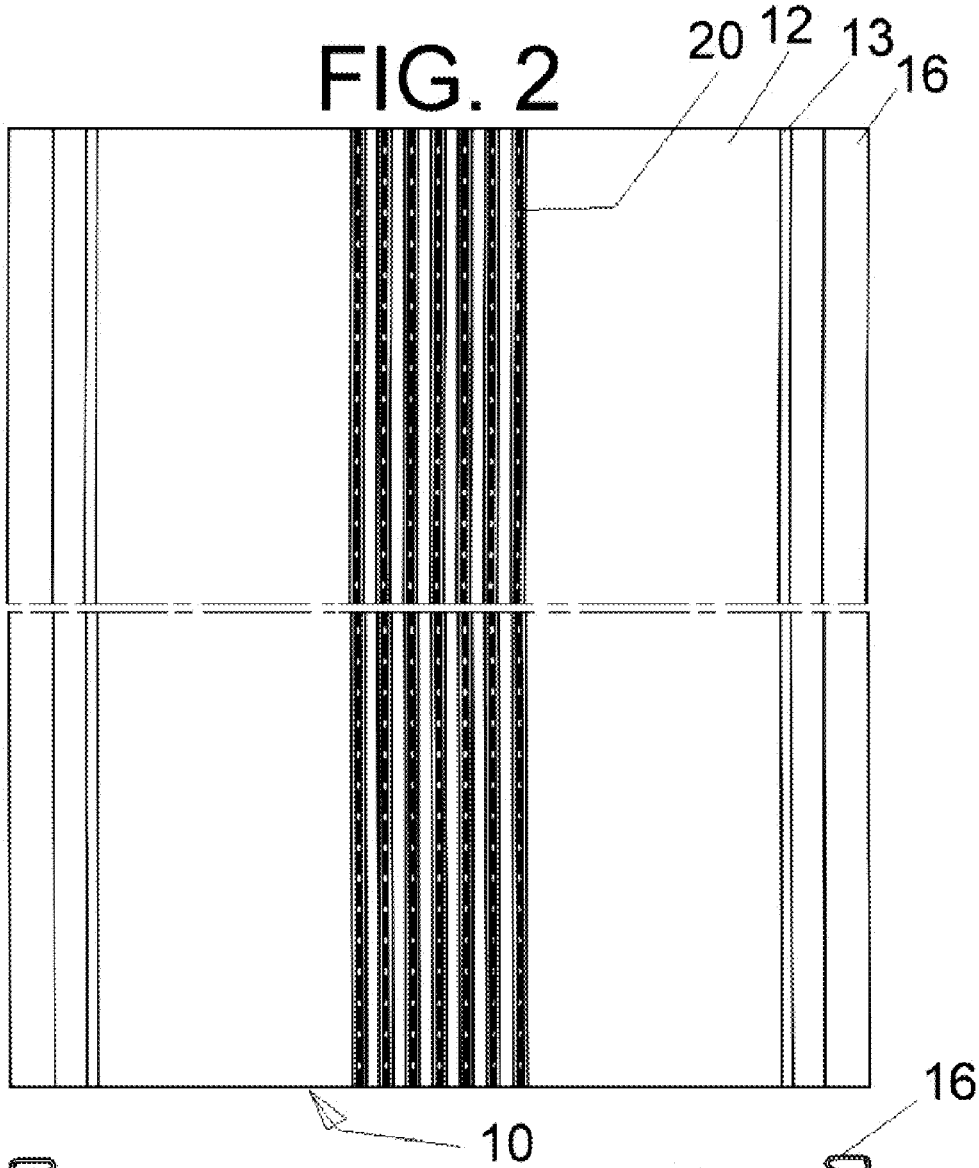
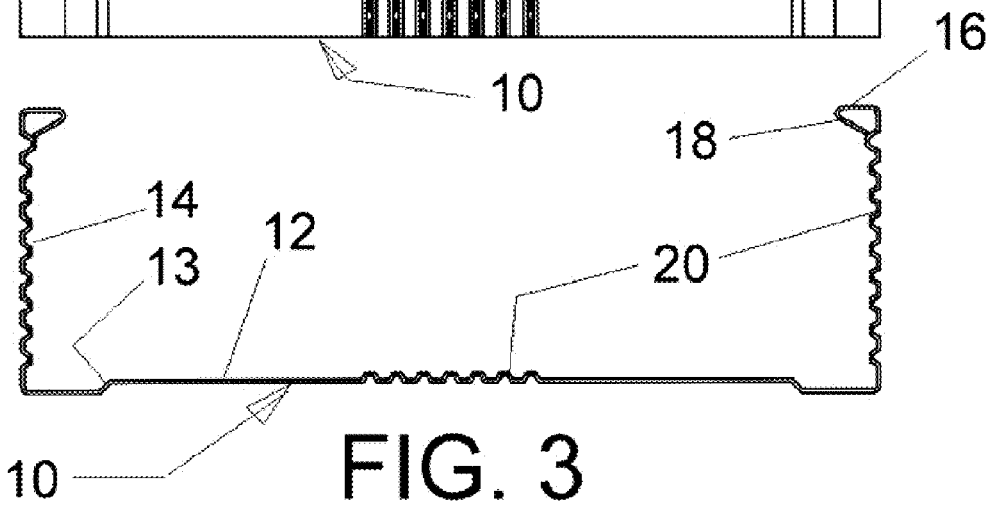
FIG. 3

NON LOAD-BEARING METAL WALL STUD HAVING INCREASED STRENGTH

FIELD AND BACKGROUND OF THE INVENTION

The present invention relates generally to the field of metal building components and, in particular, to a new and useful metal wall stud.

Buildings have long been constructed of structural framing systems. Wood has long been the material of choice for the components of these systems. In recent times, however, steel and other metal structural components have been created to replace the wood framing components in most commercial and some residential construction. Thus, the erecting of interior partitions within buildings to divide the interior space into smaller sections or areas is commonly completed by erecting a framework of metal studs.

The inventor of the subject application has invented or co-invented various improvements in the field including U.S. Pat. No. 7,478,505 for Metal Stud Arrangement; U.S. Pat. No. 7,383,665 for Header Arrangement; U.S. Pat. No. 7,356,970 for Metal Building Construction; U.S. Pat. No. 6,964,140 for Structural Metal Member for Use in a Roof Truss or a Floor Joist; U.S. Pat. No. 6,436,552 for Structural Metal Framing Member; U.S. Pat. No. 6,397,550 for Metal Structural Member; U.S. Pat. No. 6,213,679 for Deflection Slide Clip; U.S. Pat. No. 5,846,018 for Deflection Slide Clip; U.S. Pat. No. 5,836,131 for Joist Hanger; U.S. Pat. No. 5,720,571 for Deflection Slide Clip; U.S. Pat. No. 5,687,538 for Floor Joist with Built-in Truss-like Stiffner; and U.S. Pat. No. 5,561,955 for Adjustable Sill Plate Assembly.

Published Patent Application Serial No. U.S. 2006/0075715 discloses a structural framing system and components thereof that includes at least one first framing component having upper and lower flange elements separated by a web element having a depth measured between the upper and lower flange elements, the upper and lower flange elements having upper and lower positioning dimples spaced thereal-ong. The dimples protrude in such manner that a distance between the upper and lower dimples is less than the depth of the web.

U.S. Pat. No. 6,092,349 discloses an elongate structural member that can be used as a wall stud, and that has a substantially uniform material gauge, at least one web element and at least one flange element. The flange element has a plurality of corrugations as stiffeners in the longitudinal direction of the member. The corrugations are equally spaced and are formed at least in the flange element, with no corrugations being located in a longitudinal direction at, adjacent to, a centerline of a web element.

Also known from The Steel Network, Inc., are heavy gage metal (e.g. 33 to 118 mils or thousandths of an inch) supporting wall members called the STIFFWALL and SIGMASTUD members, that each have a 90 degree skirt at the edge of a flange lip. See http://www.steelnetwork.com/SigmaStud.aspx and http://www.steelnetwork.com/StiffWall.aspx?link_id=2, for example.

Some of the structural members described above provide reasonable support but, at an increased thickness. Others have a reduced thickness, but do not provide adequate support.

A need remains, therefore, for a non load-bearing metal wall stud with increased strength but reduced metal weight. The increased strength referred to is deflection on the flange of the stud. By increasing the strength of the flange the invention will allow the stud to achieve a greater height without increasing the gauge of the steel. Some manufactures increase the Ksi (thousand pound per square inch of tensile strength) of the steel to increase the ability of the stud to achieve greater heights, but using a higher Ksi steel, for example 50 Ksi, makes the installation of self taping screws that are commonly used to attach wall board to the studs, more difficult. By stiffening the lip of the stud the invention achieves a greater stud height without the use of high Ksi grade steel.

SUMMARY OF THE INVENTION

It is an object of the present invention provide a steel member which is particularly suited for use in non load-bearing dry wall partitions.

It is an object of the present invention to provide a metal wall stud having a substantially uniform material gauge, which substantially overcomes or ameliorates disadvantages of known structural members.

It is an object of the present invention to provide a metal wall stud having an increased strength, in particular, increased deflection resistance, without the necessity of increasing the thickness or tensile strength thereof.

It is also an object of the present invention to provide a non load-bearing metal wall stud that can be made with reduced sheet metal wall thickness while providing increased strength by including in the sheet metal body of the stud a skirt that is bent inwardly from the flange lip at a non-right angle and, optionally, a pattern of knurled parallel channels in the flange and, further optionally, in an central area of the web as well.

It is also an object of the present invention to provide an alternative to known structural members which overcomes the shortcomings and disadvantages of known structural members.

With a view to achieving the foregoing and other objectives the invention comprises an elongate metal, preferably steel, wall stud, for use in non load-bearing structures such as, for example, internal walls, and having a web defining side edges, at least one flange formed at an angle on at least one side edge, the flange and the web defining inside surfaces and outer surfaces opposite to one another, and being characterized, optionally, by a pattern of knurled parallel channels in the flange and, further optionally, in an area of the web as well.

Embodiments of the present invention also include a metal member wherein a second flange is formed on a second side edge of the web, the second flange being angled at an angle of preferably 90 degrees to the web.

Further, metal wall studs according to the present invention include a pair of lips, each extending at a right angle from the straight edge of one of the flanges, toward the inner surface of the respective flange and over the inner surface of the web, each lip having an inner surface and a straight edge.

Embodiments of the present invention further include a pair of skirts, each extending at an angle from the straight edge of one of the lips, toward the inner surface of the respective flange and over the inner surface of the lip, each of the skirts having an inner surface and a free straight edge, the free straight edges of the skirts being spaced from the inner surface of the flange. In certain embodiments, the free edge of the skirts contact the inner surface of the flange.

Embodiments of the present invention may also include a non load-bearing metal wall stud comprising: a sheet metal body of about 0.013 to 0.032 inches thickness, the sheet metal body having; a web of about 2 to 6 inches width, the web having an inner surface and opposite straight edges; a pair of flanges each of about 1.000 to 2.000 inches width and each extending at a right angle to the web at one of the straight edges of the web and outwardly in the same direction from the inner surface of the web, each flange having an inner surface and a straight edge; a pair of lips each of about 0.100 to 0.400 inches width and each extending at a right angle from the straight edge of one of the flanges, toward the inner surface of the respective flange and over the inner surface of the web, each lip having an inner surface and a straight edge; a pair of skirts each of about 0.075 to 0.450 inches width and each extending at an angle of from about 25 to 75 degrees from the straight edge of one of the lips, toward the inner surface of the respective flange and over the inner surface of the lip, each skirt having an inner surface and a free straight edge; the free straight edge of the skirt being spaced from the inner surface of the flange by about 0.000 to 0.375 inches; and the connections between the web and the pair of flanges, and between the flanges and the lips, and between the lips and skirts, each being a radius bend in the sheet metal body of about 0.020 to 0.040 inches.

These measurements are preferred for maximum benefit for the invention, that is maximums strength for minimum material thickness and weight of the stud. The studs may also be formed of lighter gauge sheet metal for some applications, and heavier gauge for other applications. Similarly other specifications of the studs may vary from one application to another.

According to one aspect of the present invention, there is provided a metal wall stud, having a substantially uniform material gauge, the stud having a web element and at least one flange element, wherein the stud has a means for stiffening along its longitudinal direction, the means comprising a plurality of knurled parallel channels formed at least in the flange element. In some embodiments, the web also has knurled parallel channels located along its longitudinal direction.

In one embodiment, the plurality of knurled parallel channels is formed at least partially across the width of the web element. In a further embodiment, the plurality of knurled parallel channels is formed at least partially across the width of the flange.

In certain embodiments, the plurality of knurled parallel channels formed in the flange element extends across the entire width of the flange element.

In further embodiments, the structural member comprises two flange elements and one web element, the member being formed generally as a U-channel.

In these embodiments, the free edge of the flange elements have a lip having extending therealong, for added stiffness.

In these embodiments, the lips have a free edge thereon and skirts extending along the free edges of the lips, for yet further added stiffness.

The stud described herein can be used for general construction, and can be made wider, or of heavier gauge metal, to suit many different applications.

Embodiments of the present invention include pattern of knurled parallel channels in the flanges and, optionally, in a region of the inner surface of the web. In some of these embodiments, the free straight edge of the skirt contacts one or more of the knurled parallel channels.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

FIG. 2 is a side elevational view of a metal stud according to embodiments of the present invention;

FIG. 3 is a top plan view of a metal stud according to embodiments of the present invention, the bottom being identical;

DESCRIPTION OF THE PREFERRED EMBODIMENTS

The invention provides sheet metal studs, suitable for use in erecting various structures such as internal partition walls and the like.

Figure 1:
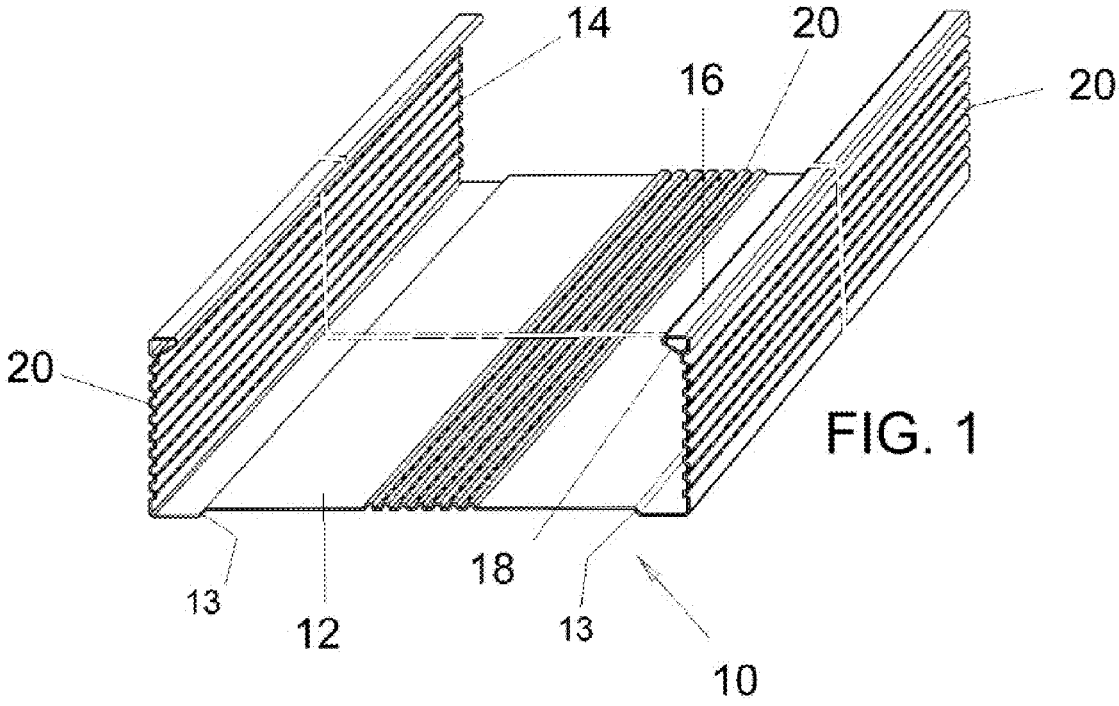
FIG. 1 is a perspective view of a metal stud according to embodiments of the present invention.
Figure 4:
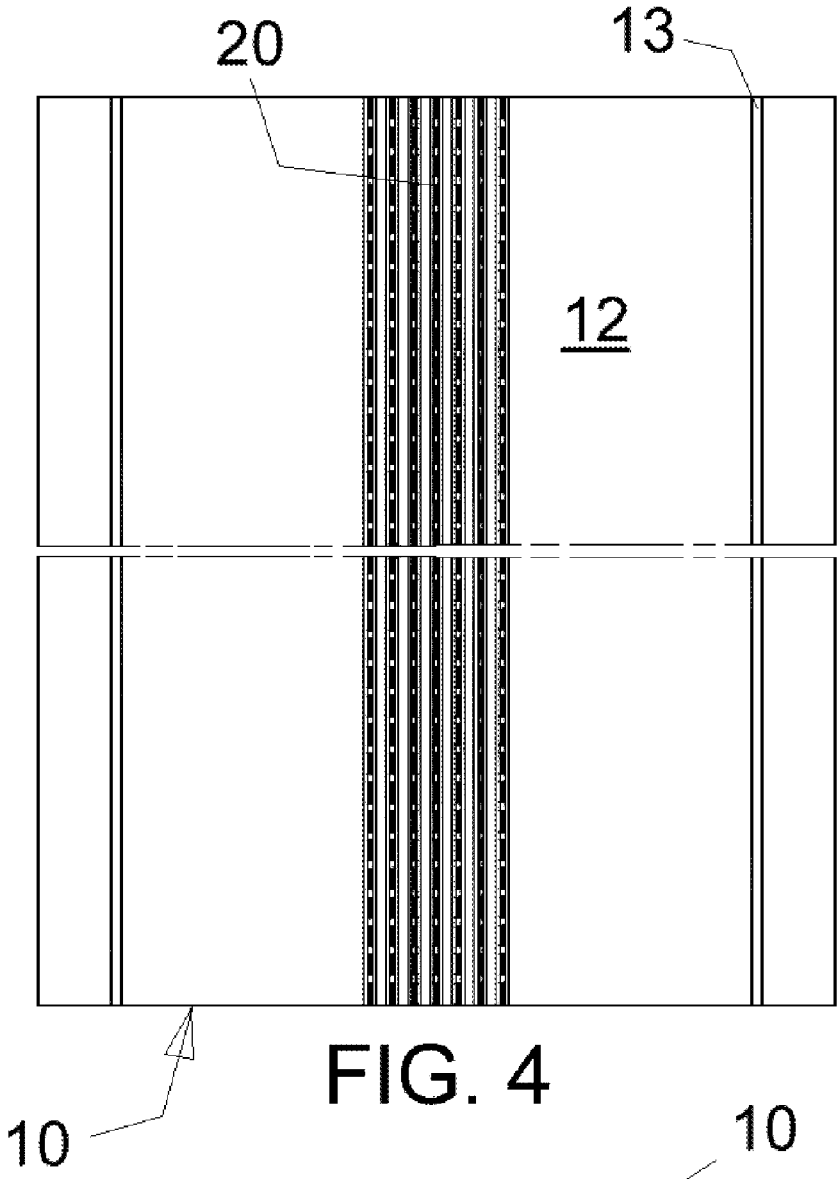
FIG. 4 is an opposite side elevational view of a metal stud according to embodiments of the present invention.

Referring now to FIG. 1, a preferred embodiment of the invention there illustrated comprises a metal stud generally designated 10, which is formed of sheet metal, preferable galvanize or otherwise anti-corrosion treated steel. The steel of the present invention can be selected to have a tensile strength of about 33 to 45 Ksi (thousand pounds per square inch) so that installation using self taping screws is expedited.

The stud 10 is formed of an initially flat sheet of metal that is bent into shape by known forming equipment. The stud 10 is thus formed to include a web 12 which is essentially planar, and edge flanges 14 along each side edge of the web 12. Each of the flanges 14 is formed by bending the sheet metal at opposite side edges of the web 12, at right angles. Lips 16 are formed on the outer edge of each flange 14, again by bending the sheet metal material at right angles to the flanges. Further, skirts 18 are formed on each lip 16, at a angle to each lip.

Figure 6:
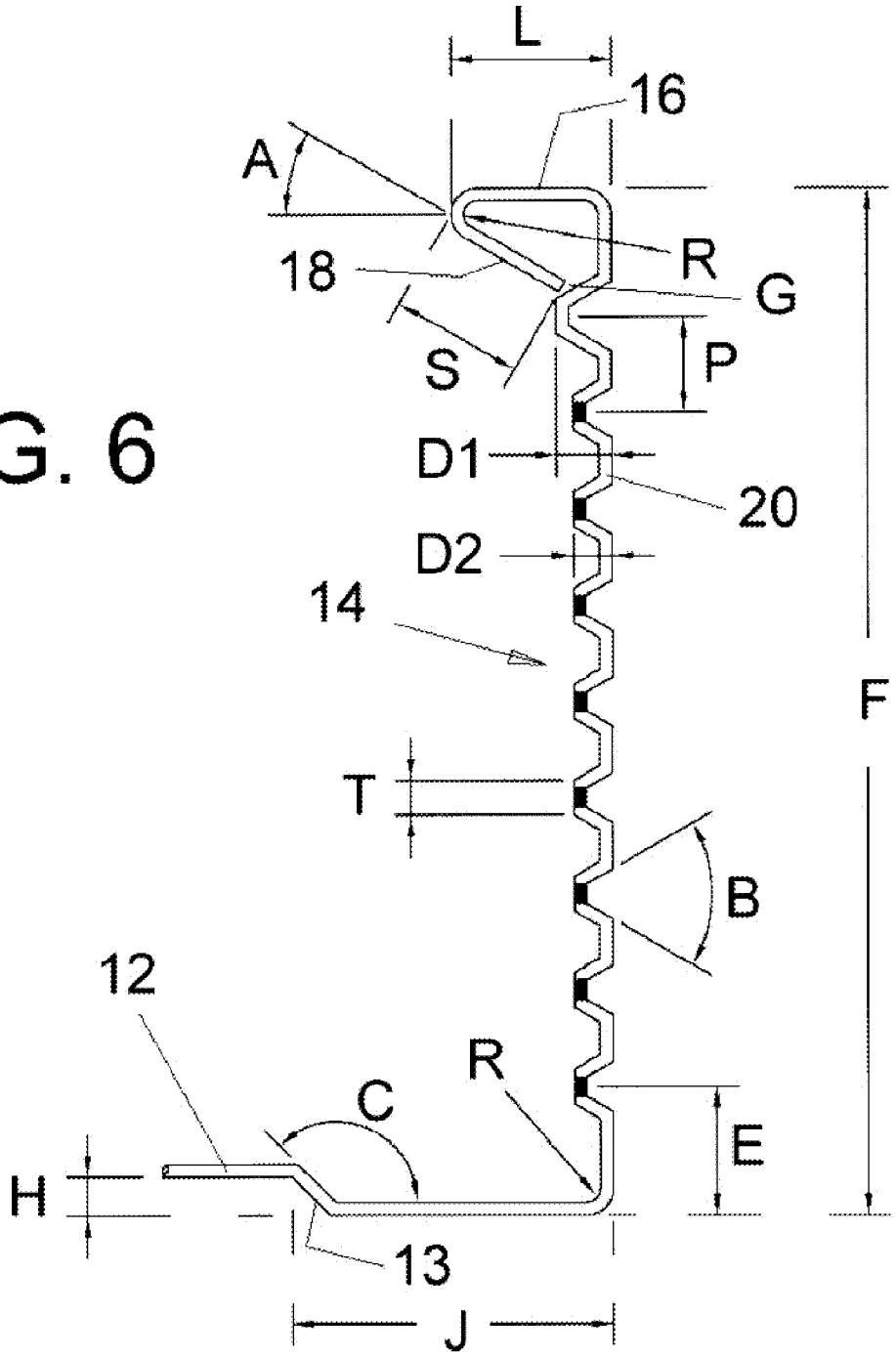
FIG. 6 is an enlarged view of the ridge and skirt area of the flange.

In preferred embodiments of the present invention each of the skirts 18 extends at an angle A of from about 25 to 75 degrees to the plane of the lip 16, from the straight edge of one of the lips, as best shown in FIG. 6.

The flanges 14, and the web 12 define a generally U-shape in section, having inside surfaces around the inside of the U-shape, and outer surfaces around the outside of the U-shape.

Knurled parallel channels 20 are preferably formed to create a knurling in the flanges 14 for greater deflection resisting strength. Knurled parallel channels 20 may also be formed along web 12 as shown in FIGS. 1 to 4, for even greater deflection resisting strength.

The knurled parallel channels 20 enable the studs to be made of a reduced thickness or thinner gauge of sheet metal, without sacrificing anything in their deflection resisting capacity.

FIGS. 1 to 6 illustrate various aspects of a typical stud 10 of the invention, with knurled parallel channels 20. The dimensions of the stud 10 may vary in terms of web width, flange width, lip height, and skirt height.

It has been found by strength tests performed on studs made according to the present invention, that the stud of the invention meets or exceeds all building code requirements of the various jurisdictions where the stud of the present invention is to be used.

Preferred dimensions and parameters for the stud of the invention have been carefully selected to meet the building code requirements of the industry and also to make studs of commercially required dimension available for non load-bearing walls. The sheet metal material is selected to have about 0.013 to 0.032 inches thickness, with a web 12 of about 2 to 6 inches width, the web 12 having an inner surface and opposite straight edges, the pair of flanges 14 each of about 1.000 to 2.000 inches width F in FIG. 6, and each extending at a right angle to the web 12 at one of the straight edges of the web and outwardly in the same direction from the inner surface of the web 12, each flange 14 having an inner surface and a straight edge.

As best also shown in FIG. 6, the pair of lips 16 are each of about 0.100 to 0.400 inches width L and each extend at about a right angle from the straight edge of one of the flanges 14 and over the inner surface of the web 12. Each lip 16 has an inner surface and a straight edge. The pair of skirts 18 each are of about 0.075 to 0.450 inches width S and each extend at an angle A of from about 25 to 75 degrees from the straight edge of one of the lips 16 toward the inner surface of the respective flange 14 and over the inner surface of the lip 16. Each skirt 18 has an inner surface and a free straight edge, the free straight edge of the skirt 18 being spaced from the inner surface of the flange 14, that is to the nearest part of the knurled parallel channels 20, by a gap G of about 0.000 to 0.037 inches. The top of the flange 14, the lip 16 and the skirt 18 form a triangle and a channel of knurling 20 closest to the lip 16 is deeper than remaining channels in the knurling so that the deeper channel cooperates with the skirt 18 to increase an overall deflection resisting strength of the stud.

The connections between the web 16 and the pair of flanges 14, and between the flanges 14 and the lips 16, and between the lips 16 and skirts 18, each have a radius bend R that can be the same of different from each other, and shown for example in FIG. 6, in the sheet metal body, of about 0.020 to 0.040 inches.

The structure and dimensions of the knurled parallel channels 20 in the flanges 14 and, preferably also in the web 12, as also shown in FIG. 6, is formed by toothed wheels of the forming equipment (not shown) and has a preferred spacing or pitch P between peaks of about 0.100 inches, or about 0.080 to 0.140 inches. The depth D1 of the one deepest channel that is adjacent the lip 16 and skirt 18, is about 0.065 inches, or about 0.050 to 0.080 inches, with the depth D2 of the remaining channels being about 0.045 inches, or about 0.030 to 0.055 inches. The width T of the peak of each channel on the inside surface of the flange 14 or web 12, is about 0.040 inches, or 0.030 to 0.050 inches. The angle B between the inclined walls of each channel is about 60 degrees, or about 40 to 80 degrees. The spacing E between the center of the peak of the channel on flange 14 nearest the web 12 is about 0.015 inches, or about 0.012 to 0.018.

For even further deflection resisting strength, the inventor has found that in the plurality of channels 20 making up the flange knurling, the channel closest to the lip 16 should be deeper (dimension D1) than the remaining channels (of depth D2), preferably toward the inner surface of the flange 14, so that this channel, in effect, reaches out to the shirt 18, and cooperates more closely with the shirt 18 to increase the overall deflection resisting strength of the stud. The deeper closest channel in the knurling is about 10 to 40% deeper (dimension D1 to D2), the outer surfaces of the channels all being in the same outer plane of the flange 14, and the deeper channel also being about 10 to 40% wider in the dimension P than the other channel in the knurling.

As shown in FIG. 1, the channels 20 if present in the web 12, are centered in a group on the web and are about 0.600 inches wide (or about 0.400 to 0.800) so that the same toothed wheel (not shown) can be used to make the channels in the web, whether the web 12 is at its minimum width of about 2 inches (to be used as a 2×2 stud) or its maximum width of 6 inches (to be used as a 2×6 stud). The web 12 is also further strengthened by including a central plateau on which centered channels 20 are places, formed by a pair of steps 13 each of width H of about 0.045 inches (or about 0.030 to 0.060 inches) spaced by a distance J of about 0.375 inches (or about 0.020 to 0.050 inches) from the flange 14 and having a step angle C of about 135 degrees (or about 100 to 160 degrees).

A typical embodiment of the present invention is depicted in FIG. 3, which shows a top plan view of a metal wall stud structural member according to the present invention. As shown therein, the structural member 10 may have a single web element 12 with two flange elements 14 extending from either end of the web element 12 in the same direction, each having a lip 16 extending at a right angle relative to its respective flange element 14. Further, each lip 16 has the skirt element 18 extending at a non-right angle relative to its respective lip element 16.

This depiction is only a depiction of a typical view, and there are a number of variations of the metal wall stud 10 taught herein, including a single web element 12 and a single flange element 14 at an angle thereto. It is noted that the web 12 and flange 14 elements are preferably at 90 degrees to each other but can be at any desirable angle.

Figure 5:
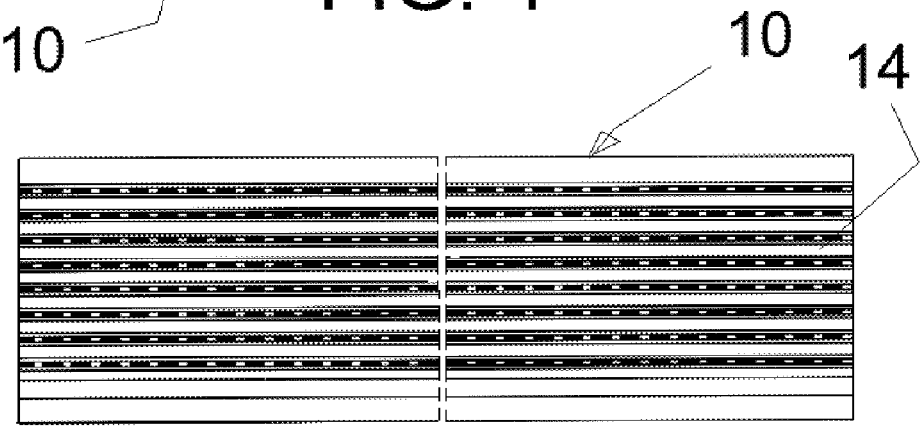
FIG. 5 is a front side elevational view of a metal stud according to embodiments of the present invention, the rear view being identical.

As shown in FIGS. 1, 3, and 5, the flange elements 14 of the metal wall stud 10, have knurled parallel channels 20 extending in the longitudinal direction along the longitudinal extent of the structural member, the knurled parallel channels 20 acting as a number of stiffeners.

However, it is also within the scope of the present invention for the knurled parallel channels 20 to be formed only partially across the width of the flange elements 14 and/or partially along the width of the web element 10. It is also within the scope of the present invention for the knurled parallel channels 20 to be at an angle to the longitudinal direction of the metal wall stud 10.

Therefore, a dry wall metal stud 10 formed of thinner gauge material than prior heavier studs has been taught. In this case, the stud 10 has a web 12, and flanges 14 with lips 16, the lips 16 having skirts 18 along the edges thereof. Flange knurled parallel channels 20 are formed in the flanges (14) and web knurled parallel channels 20 are formed in the web 12.

The design of the metal wall stud 10 according to the teaching of the present invention enables a reduction in thickness of the sheet metal used. It is anticipated that a reduction of thickness can be achieved while still providing adequate support to a wall or panel. This will reduce the cost of the walls and panels.

Thus, a surprisingly strong, lightweight, dry wall metal stud 10, having a reduced thickness has been described. The knurled parallel channels 20 located in the flanges 14 and, optionally, in the web 12 increase the rigidity and strength of the metal wall stud. Generally, therefore, a better performing stud for drywall framing has been described.

This stud 10 is generally intended for internal use, typically in the erecting of walls or partitions between spaces in a commercial or office building, for example. Embodiments of the present invention are not limited to these uses, however.

While a specific embodiment of the invention has been shown and described in detail to illustrate the application of the principles of the invention, it will be understood that the invention may be embodied otherwise without departing from such principles.

What is claimed is:

1. A non load-bearing metal wall stud comprising:

a sheet metal body (10) having a thickness of about 0.013 to 0.032 inches, the sheet metal body having;

a web (12) having a width of about 2 to 6 inches, the web (12) having an inner surface and opposite straight edges;

a pair of flanges (14) each having a width of about 1.00 to 2.00 inches and each extending at a right angle to the web (12) at one of the straight edges of the web (12) and outwardly in the same direction from the inner surface of the web (12), each flange (14) having an inner surface and a straight edge;

a pair of lips (16), each having a width of 0.100 to 0.400 inches and each extending at a right angle from the straight edge of one of the flanges (14) and over the inner surface of the web (12), each of said lips (16) having an inner surface and a straight edge;

a pair of skirts (18) each having a width of about 0.075 to 0.450 inches and each extending at an angle of about 25 to 75 degrees from the straight edge of one of the lips (16), toward the inner surface of the respective flange (14) and over the inner surface of the lip (16), each skirt (18) having an inner surface and a free straight edge and the flange (14), the lip (16) and the skirt (18) together forming a triangle;

the free straight edge of the skirt (18) being substantially in contact with the inner surface of the flange (14) to increase an overall deflection resisting strength of the stud;

the connections between the web (12) and the pair of flanges (14), and between the flanges (14) and the lips (16), and between the lips (16) and skirts (18), each being a radius bend in the sheet metal body of about 0.020 to 0.040 inches;

a plurality of parallel channels (20) forming a knurling in the flange, said knurling extends substantially entirely across a width of each flange, a channel (20) closest to the lip (16) being deeper (D1) than remaining channels (D2) in the knurling so that the deeper channel cooperates with the skirt (18) to increase an overall deflection resisting strength of the stud; and a plurality of parallel channels (20) formed in the web (12) and centered in a group on the web, the group being about 0.400 to 0.800 inches wide;

the web (12) including a central plateau on which the centered group of channels (20) are disposed, the central plateau being formed of steps (13) each of width (H) of about 0.030 to 0.060 inches and each spaced by a distance (J) of about 0.020 to 0.050 inches from the nearest flange (14) and having a step angle (C) of about 100 to 160 degrees.

2. The metal wall stud of claim 1, wherein said sheet metal body (10) has a thickness of about 0.015 to 0.030 inches and is made of steel having a tensile strength of about 33 to 45 Ksi.

3. The metal wall stud of claim 1, wherein said web (12) has a width of about 3 to 5 inches.

4. The metal wall stud of claim 1, wherein each of said flanges (14) has a width of about 1.25 to 1.75 inches.

5. The metal wall stud of claim 1, wherein each of said lips (16) has a width of about 0.125 to 0.175 inches.

6. The metal wall stud of claim 1, wherein each of said skirts (18) has a width of about 0.125 to 0.225 inches.

7. The metal wall stud of claim 1, wherein each of said skirts (18) extends at an angle of about 30 to 60 degrees.

8. The metal wall stud of claim 1, wherein the connections between the web (12) and the pair of flanges (14), and between the flanges (14) and the lips (16), and between the lips (16) and skirts (18), are each a radius bend in the sheet metal body of about 0.025 to 0.035 inches.

* * * * *